US009818520B2

(12) United States Patent
Kishimoto et al.

(10) Patent No.: US 9,818,520 B2
(45) Date of Patent: Nov. 14, 2017

(54) RARE-EARTH NANOCOMPOSITE MAGNET

(71) Applicants: Hidefumi Kishimoto, Susono (JP); Noritsugu Sakuma, Susono (JP); Masao Yano, Sunto-gun (JP); Weibin Cui, Tsukuba (JP); Yukiko Takahashi, Tsukuba (JP); Kazuhiro Hono, Tsukuba (JP)

(72) Inventors: Hidefumi Kishimoto, Susono (JP); Noritsugu Sakuma, Susono (JP); Masao Yano, Sunto-gun (JP); Weibin Cui, Tsukuba (JP); Yukiko Takahashi, Tsukuba (JP); Kazuhiro Hono, Tsukuba (JP)

(73) Assignees: TOYOTA JIDOSHA KABUSHIKI KAISHA, Toyota (JP); NATIONAL INSTITUTE FOR MATERIALS SCIENCE, Tsukuba (JP)

( * ) Notice: Subject to any disclaimer, the term of this patent is extended or adjusted under 35 U.S.C. 154(b) by 691 days.

(21) Appl. No.: 14/368,541

(22) PCT Filed: Dec. 27, 2012

(86) PCT No.: PCT/JP2012/083988
§ 371 (c)(1),
(2) Date: Jun. 25, 2014

(87) PCT Pub. No.: WO2013/103132
PCT Pub. Date: Jul. 11, 2013

(65) Prior Publication Data

US 2015/0008998 A1 Jan. 8, 2015

(30) Foreign Application Priority Data

Jan. 4, 2012 (JP) ..... 2012-000155

(51) Int. Cl.
*H01F 7/02* (2006.01)
*C22C 38/00* (2006.01)
(Continued)

(52) U.S. Cl.
CPC ..... *H01F 7/02* (2013.01); *C22C 38/005* (2013.01); *H01F 1/0311* (2013.01); *H01F 10/126* (2013.01)

(58) Field of Classification Search
CPC ..... H01F 7/02; H01F 10/126; H01F 1/0311; C22C 38/005
(Continued)

(56) References Cited

U.S. PATENT DOCUMENTS 5,382,304 A * 1/1995 Cockayne et al. .... H01F 1/0311 148/306
5,538,565 A * 7/1996 Akioka et al. ..... B22F 9/023 148/101
(Continued)

FOREIGN PATENT DOCUMENTS

CN 1271169 A 10/2000
CN 1182268 C 12/2004
(Continued)

OTHER PUBLICATIONS

"The structures and magnetic properties of 2:14:1-type RT-TM intermetallic powders and double-phased multilayer flms and investigations of the magneto-caloric effects in MgAs-based intermetallics", Weibin Cui, submitted for the degree of Doctor of Philosophy in Materials Physics and Chemistry, Institute of Metal Research, Chinese Academy of Science (May, 2009).
(Continued)

*Primary Examiner* — Kiley Stoner
(74) *Attorney, Agent, or Firm* — Oliff PLC

(57) ABSTRACT

The invention provides a nanocomposite magnet, which has achieved high coercive force and high residual magnetiza-
(Continued)

(1)

tion. The magnet is a non-ferromagnetic phase that is intercalated between a hard magnetic phase with a rare-earth magnet composition and a soft magnetic phase, wherein the non-ferromagnetic phase reacts with neither the hard nor soft magnetic phase. A hard magnetic phase contains $Nd_2Fe_{14}B$, a soft magnetic phase contains Fe or $Fe_2Co$, and a non-ferromagnetic phase contains Ta. The thickness of the non-ferromagnetic phase containing Ta is 5 nm or less, and the thickness of the soft magnetic phase containing Fe or $Fe_2Co$ is 20 nm or less. Nd, or Pr, or an alloy of Nd and any one of Cu, Ag, Al, Ga, and Pr, or an alloy of Pr and any one of Cu, Ag, Al, and Ga is diffused into a grain boundary phase of the hard magnetic phase of $Nd_2Fe_{14}B$.

4 Claims, 10 Drawing Sheets

(51) Int. Cl.
*H01F 1/03* (2006.01)
*H01F 10/12* (2006.01)

(58) Field of Classification Search
USPC ..... 335/302
See application file for complete search history.

(56) References Cited

U.S. PATENT DOCUMENTS

| | | | | |
|---|---|---|---|---|
| 5,725,792 | A | 3/1998 | Panchanathan | |
| 6,078,237 | A * | 6/2000 | Nomura et al. | B82Y 25/00 252/62.54 |
| 6,172,589 | B1 * | 1/2001 | Fujita et al. | H01F 1/0571 335/302 |
| 6,261,385 | B1 * | 7/2001 | Nomura et al. | H01F 1/0579 148/101 |
| 6,280,536 | B1 * | 8/2001 | Inoue et al. | B82Y 25/00 148/302 |
| 6,329,894 | B1 * | 12/2001 | Kanekiyo et al. | B82Y 25/00 148/302 |
| 6,425,961 | B1 * | 7/2002 | Kojima et al. | B22F 1/0003 148/302 |
| 6,444,052 | B1 * | 9/2002 | Honkura et al. | B22F 9/023 148/101 |
| 6,471,786 | B1 * | 10/2002 | Shigemoto et al. | B22F 1/0044 148/101 |
| 6,555,018 | B2 * | 4/2003 | Sellers et al. | B22F 3/225 148/302 |
| 6,676,773 | B2 * | 1/2004 | Kaneko et al. | B22F 9/008 148/302 |
| 6,695,929 | B2 * | 2/2004 | Kanekiyo et al. | B22D 11/0611 148/101 |
| 6,805,980 | B2 * | 10/2004 | Uehara | B82Y 25/00 148/306 |
| 6,819,211 | B2 * | 11/2004 | Yoshimura et al. | H01F 41/026 335/302 |
| 6,941,637 | B2 * | 9/2005 | Fukunaga et al. | H01F 1/0027 148/100 |
| 2002/0003006 | A1 | 1/2002 | Nishimoto et al. | |
| 2002/0129874 | A1 | 9/2002 | Kaneko et al. | |
| 2005/0190031 | A1 * | 9/2005 | Miyata | H01F 41/026 335/302 |
| 2006/0005898 | A1 | 1/2006 | Liu et al. | |
| 2006/0038247 | A1 | 2/2006 | Noh et al. | |
| 2011/0266894 | A1 | 11/2011 | Yamashita et al. | |

FOREIGN PATENT DOCUMENTS

| | | | |
|---|---|---|---|
| DE | 697 20 2015 | T2 | 2/2004 |
| DE | 698 19 953 | T2 | 11/2004 |
| JP | 2001323343 | A | 11/2001 |
| JP | A-2004-356544 | | 12/2004 |
| JP | A-2005-93731 | | 4/2005 |
| JP | A-2010-74062 | | 4/2010 |
| JP | B2-4988713 | | 8/2012 |
| JP | A-2012-234985 | | 11/2012 |
| JP | A-2012-235003 | | 11/2012 |
| JP | 6117706 | B2 | 4/2017 |
| WO | WO 2007/119271 | A1 | 10/2007 |
| WO | 2013/103132 | A1 | 7/2013 |

OTHER PUBLICATIONS

Kim et al, "Effect on Nd/Fe ratio on the microstructure and magnetic properties of NdFeB thin films", Journal of Magnetism and Magnetic Materials 234 (2001), pp. 489-493.

H. Jiang et al, "Structure and magnetic properties of NdFeB thin films with Cr, Mo, Nb, Ta, Ti and V buffer layers", Journal of Magnetism and Magnetic Materials 212 (2000) pp. 59-68.

W. B. Cui et al, "Microstructure optimization to achieve high coercivity in anisotropic Nd-Fe-B thin films", Acta Materialia 59 (2011) 7768-7775.

S. Zhou et al, Ultra strong Permanent Magnet-Rare Earth Iron series Permanent Magnetic Material (Second Edition), p. 16, 565, Metallurgical Industry Press (2013).

W.B. Cui et al, "Anisotropic behavior of exchange coupling in textured Nd2Fe14B/a-Fe multilayer films", Journal of Applied Physics 104, 053903 (2008).

* cited by examiner (1)

(2)

(1)

(2)

(1)

(2)

(1)

(2)

RARE-EARTH NANOCOMPOSITE MAGNET

TECHNICAL FIELD

The present invention relates to a nanocomposite magnet having a hard magnetic phase with a rare-earth magnet composition and a soft magnetic phase.

BACKGROUND ART

A rare-earth nanocomposite magnet, in which a hard magnetic phase with a rare-earth magnet composition and a soft magnetic phase are mixed up together in a nano size (several nm to several tens of nm), can achieve high residual magnetization, coercive force, and maximum energy product owing to exchange interaction acting between a hard magnetic phase and a soft magnetic phase.

However a texture having both a hard magnetic phase and a soft magnetic phase has had a drawback in that magnetization reversal occurs in a soft magnetic phase and propagation of the magnetization reversal cannot be prevented which leads to low coercive force.

As a countermeasure, a nanocomposite magnet, in which the residual magnetization and coercive force are improved by forming a 3-phase texture with an intercalated R—Cu alloy phase (thickness unknown, R is one, or 2 or more kinds of rare-earth elements) between a $Nd_2Fe_{14}B$ phase (hard magnetic phase) and an α-Fe phase (soft magnetic phase), and thereby preventing the magnetization reversal from propagation, is disclosed in Patent Literature 1.

However, there is another drawback in the texture according to Patent Literature 1, in that the R—Cu phase intercalated between a hard magnetic phase and a soft magnetic phase impedes exchange coupling between a hard magnetic phase and a soft magnetic phase, and moreover the intercalated R—Cu phase reacts with both the hard magnetic phase and the soft magnetic phase so as to extend the distance between the hard soft phase and the soft phase and inhibit good exchange coupling, resulting in low residual magnetization.

CITATION LIST

Patent Literature

[Patent Literature 1] Japanese Laid-open Patent Publication No. 2005-93731

SUMMARY OF INVENTION

Technical Problem

An object of the present invention is to provide a nanocomposite magnet, which has overcome the drawback in the conventional art, achieved both high coercive force and residual magnetization, and also improved maximum energy product.

Solution to Problem

In order to achieve the object, the present invention provides a rare-earth nanocomposite magnet characterized in that a non-ferromagnetic phase is intercalated between a hard magnetic phase with a rare-earth magnet composition and a soft magnetic phase, wherein the non-ferromagnetic phase reacts with neither the hard magnetic phase nor the soft magnetic phase. The term "non-ferromagnetic phase" means herein a substance not having ferromagnetism, namely a substance not having a character to exhibit spontaneous magnetization even without an external magnetic field.

Advantageous Effects of Invention

In a rare-earth nanocomposite magnet according to the present invention, a non-ferromagnetic phase intercalated between a hard magnetic phase and a soft magnetic phase as a spacer, which does not react with neither a hard magnetic phase nor a soft magnetic phase, prevents magnetization reversal occurred in the soft magnetic phase or a region with low coercive force from propagation, to suppress magnetization reversal of the hard magnetic phase, so that high coercive force can be achieve, while securing high residual magnetization.

DESCRIPTION OF EMBODIMENTS

A rare-earth nanocomposite magnet according to the present invention has a texture, wherein between a hard magnetic phase with a rare-earth magnet composition and a soft magnetic phase, a non-ferromagnetic phase is intercalated, which reacts with neither the hard magnetic phase nor the soft magnetic phase.

Typically, a rare-earth nanocomposite magnet according to the present invention is a rare-earth nanocomposite magnet with a $Nd_2Fe_{14}B$ based composition, in which a hard magnetic phase is composed of $Nd_2Fe_{14}B$, a soft magnetic phase is composed of Fe or $Fe_2Co$, and a non-ferromagnetic phase is composed of Ta. With this typical composition, when $Fe_2Co$ is desirably used rather than Fe for a soft magnetic phase, the residual magnetization and the maximum energy product can be further enhanced.

With a typical composition, coercive force as high as 8 kOe or more can be achieved. As for residual magnetization, 1.50 T or more, desirably 1.55 T or more, and more desirably 1.60 T or more can be achieved.

With a typical composition, the thickness of a non-ferromagnetic phase composed of Ta is desirably 5 nm or less. When the thickness of a non-ferromagnetic phase is restricted to 5 nm or less, the exchange coupling action can be enhanced and the residual magnetization can be further improved. Further, when the thickness of a soft magnetic phase composed of Fe or $Fe_2Co$ is desirably, 20 nm or less, a high maximum energy product can be obtained stably.

With a typical composition, when any one of the following (1) to (4) is desirably diffused in a grain boundary phase of a hard magnetic phase of Nd2Fe14B:

(1) Nd, (2) Pr, (3) an alloy of Nd, and any one of Cu, Ag, Al, Ga, and Pr, and (4) an alloy of Pr, and any one of Cu, Ag, Al, and Ga, a higher coercive force can be obtained.

EXAMPLES $Nd_2Fe_{14}B$ based rare-earth nanocomposite magnets were produced according to typical compositions of the present invention.

Example 1

Figure 1:
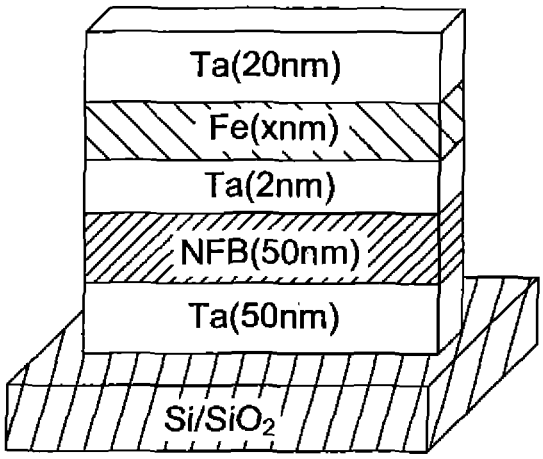
FIG. 1 is (1) a schematic diagram, and (2) a TEM micrograph of a cross-sectional structure of a rare-earth nanocomposite magnet according to the present invention formed to a film in Example 1.
Figure 1:
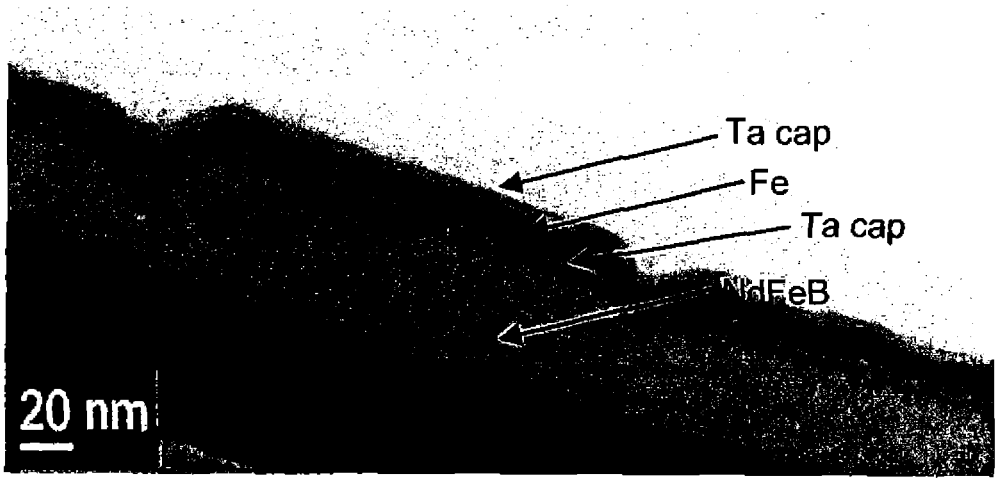

A film with the structure illustrated schematically in FIG. 1 (1) was formed by sputtering on a thermally-oxidized film ($SiO_2$) of a Si single crystal substrate. The conditions for film forming were as follows. In FIG. 1 (1) "NFB" stands for $Nd_2Fe_{14}B$.

<Film Forming Conditions>

A) lower Ta layer: formed at room temperature

B) $Nd_2Fe_{14}B$ layer: film formation at 550° C.+annealing at 600° C. for 30 min C) Ta spacer layer (intercalated layer)+α-Fe layer+Ta cap layer: film formation between 200 to 300° C.

wherein the $Nd_2Fe_{14}B$ layer of B) is a hard magnetic phase, the Ta spacer layer of C) is an intercalated layer between a hard magnetic phase and a soft magnetic phase, and the α-Fe layer of C) is a soft magnetic phase.

A TEM micrograph of a cross-sectional structure of the obtained nanocomposite magnet is shown in FIG. 1 (2).

<Evaluation of Magnetic Properties>

Figure 2:
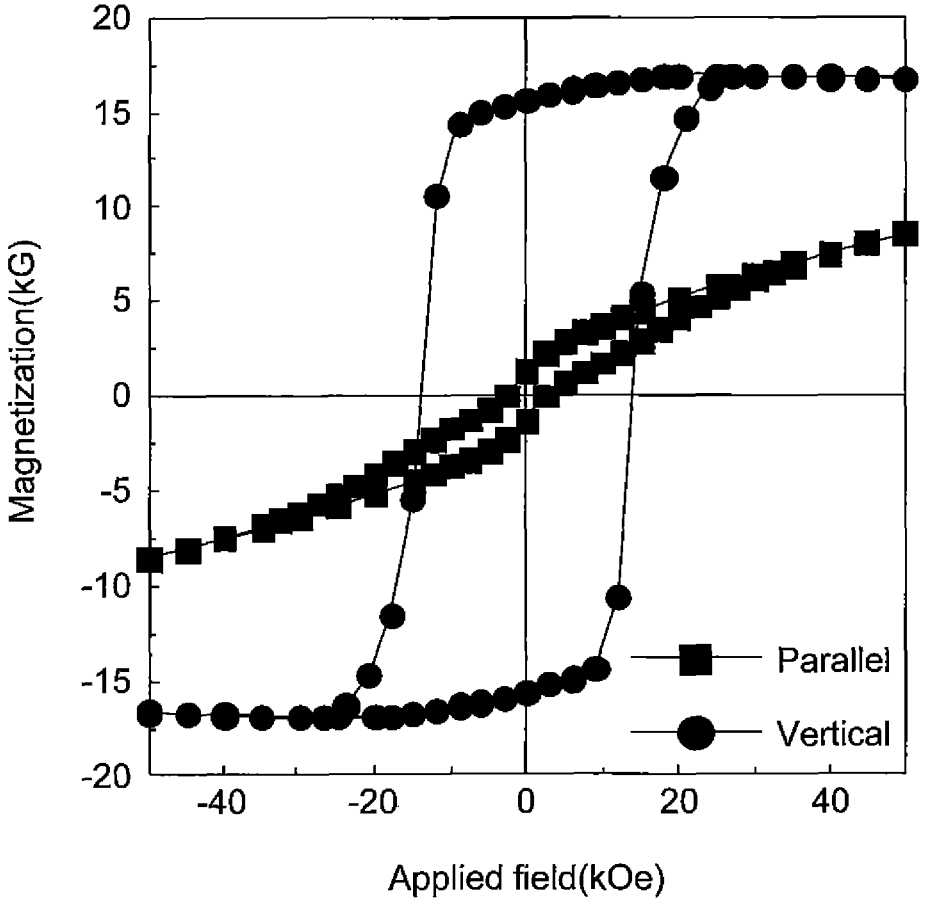
FIG. 2 is a magnetization curve of a rare-earth nanocomposite magnet according to the present invention having the structure of FIG. 1. The directions of an applied magnetic field are vertical (filled circle) and parallel (filled square) to the surface of a thin film sample.

The magnetization curve of the nanocomposite magnet produced in the current Example is shown in FIG. 2.

The directions of an applied magnetic field are vertical (plotted as filled circles in the Figure) and parallel (plotted as filled squares in the Figure) to the surface of a formed film.

Coercive force of 14 kOe, residual magnetization of 1.55 T, and maximum energy product of 51 MGOe were obtained in the vertical direction to the formed film surface. The magnetic properties were measured by a VSM (Vibrating Sample Magnetometer). The same holds for other Examples and Comparative Example.

Example 2

Figure 3:
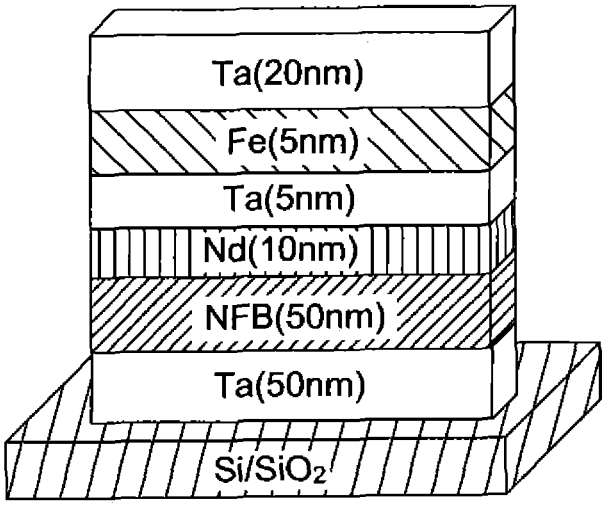
FIG. 3 is (1) a schematic diagram, and (2) a TEM micrograph of a cross-sectional structure of a rare-earth nanocomposite magnet according to the present invention formed to a film in Example 2.
Figure 3:
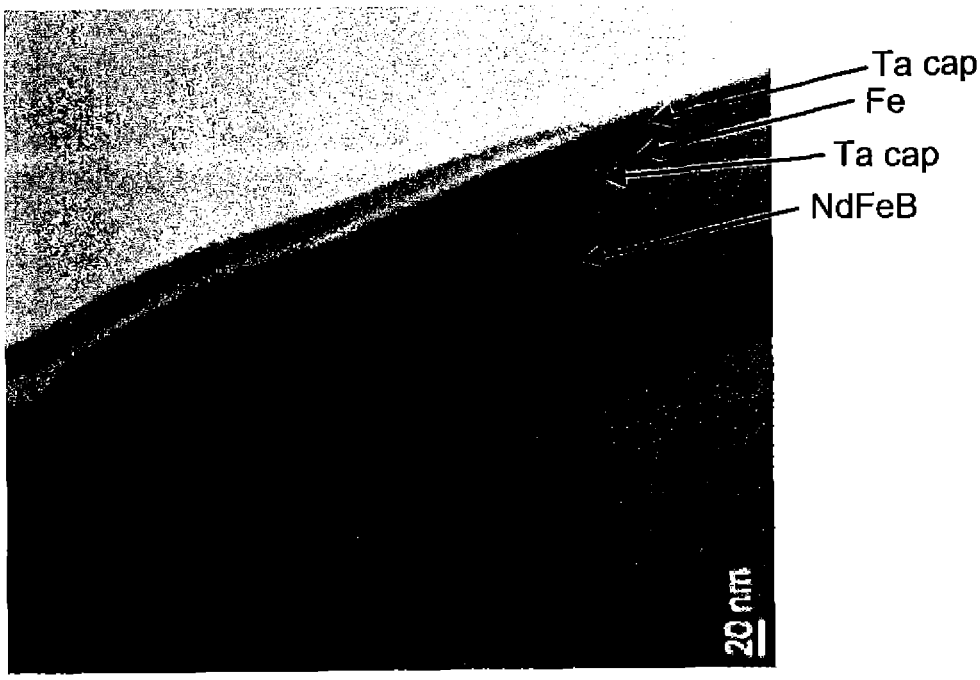

A film with the structure illustrated schematically in FIG. 3 (1) was formed by sputtering on a thermally-oxidized film ($SiO_2$) of a Si single crystal substrate. The conditions for film forming were as follows. In FIG. 3 (1) "NFB" stands for $Nd_2Fe_{14}B$.

<Film Forming Conditions>

A) lower Ta layer: formed at room temperature

B') $Nd_2Fe_{14}B$ layer+Nd layer: film formation at 550° C.+annealing at 600° C. for 30 min C) Ta spacer layer (intercalated layer)+α-Fe layer+Ta cap layer: film formation between 200 to 300° C.

wherein the $Nd_2Fe_{14}B$ layer of B') is a hard magnetic phase, the Ta spacer layer of C) is an intercalated layer between a hard magnetic phase and a soft magnetic phase, and the α-Fe layer of C) is a soft magnetic phase.

The Nd layer formed on the $Nd_2Fe_{14}B$ layer was diffused and infiltrated into a grain boundary phase of a $Nd_2Fe_{14}B$ phase during annealing.

A TEM micrograph of a cross-sectional structure of the obtained nanocomposite magnet is shown in FIG. 3 (2).

<Evaluation of Magnetic Properties>

Figure 4:
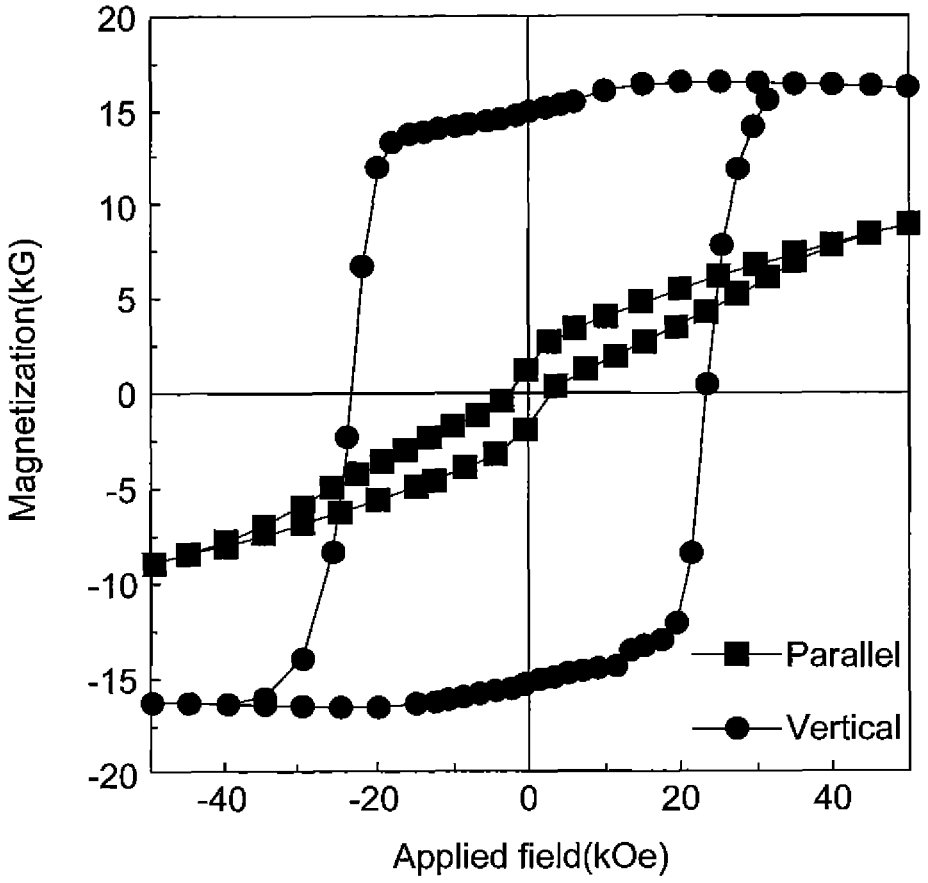
FIG. 4 is a magnetization curve of a rare-earth nanocomposite magnet according to the present invention having the structure of FIG. 3. The directions of an applied magnetic field are vertical (filled circle) and parallel (filled square) to the surface of a thin film sample.

The magnetization curve of the nanocomposite magnet produced in the current Example is shown in FIG. 4.

The directions of an applied magnetic field are vertical (plotted as filled circles in the Figure) and parallel (plotted as filled squares in the Figure) to the surface of a formed film.

Coercive force of 23.3 kOe, residual magnetization of 1.5 T, and maximum energy product of 54 MGOe were obtained in the vertical direction to the formed film surface.

In the current Example, a higher coercive force compared to Example 1 could be obtained by diffusion of Nd into a grain boundary phase of a $Nd_2Fe_{14}B$ phase. As a diffusing component, in addition to Nd, also a Nd—Ag alloy, a Nd—Al alloy, a Nd—Ga alloy, and a Nd—Pr alloy can be utilized.

Example 3

Figure 5:
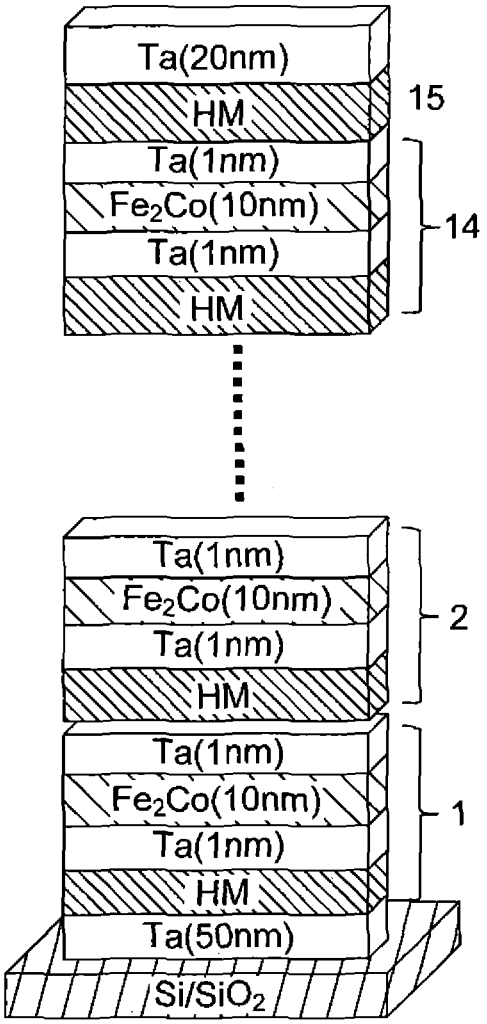
FIG. 5 is a schematic diagram of a cross-sectional structure of a rare-earth nanocomposite magnet according to the present invention formed to a film in Example 3.

A film with the structure illustrated schematically in FIG. 5 was formed by sputtering on a thermally-oxidized film ($SiO_2$) of a Si single crystal substrate. The conditions for film forming were as follows. In FIG. 5 "HM" stands for $Nd_2Fe_{14}B$ layer (30 nm)+Nd layer (3 nm).

<Film Forming Conditions>

A) lower Ta layer: formed at room temperature

B') $Nd_2Fe_{14}B$ layer+Nd layer: film formation at 550° C.+annealing at 600° C. for 30 min C) Ta spacer layer+$Fe_2Co$layer+Ta cap layer: film formation between 200 to 300° C.

wherein the $Nd_2Fe_{14}B$ layer of B) is a hard magnetic phase, the Ta spacer layer of C) is an intercalated layer between a hard magnetic phase and a soft magnetic phase, and the $Fe_2Co$ layer of C) is a soft magnetic phase.

As illustrated in FIG. 5, in the 1st cycle, the above A)+B')+C) were conducted, then in the 2nd to 14th cycles B')+C) were repeated, and in the 15th cycle B')+film formation of Ta cap layer were conducted. In other words, 15

HM layers (=$Nd_2Fe_{14}B$ layer+Nd layer) were stacked. In each HM layer, a Nd layer formed on a Nd2Fe14B layer diffused and infiltrated into a grain boundary phase of a $Nd_2Fe_{14}B$ phase during annealing.

Figure 6:
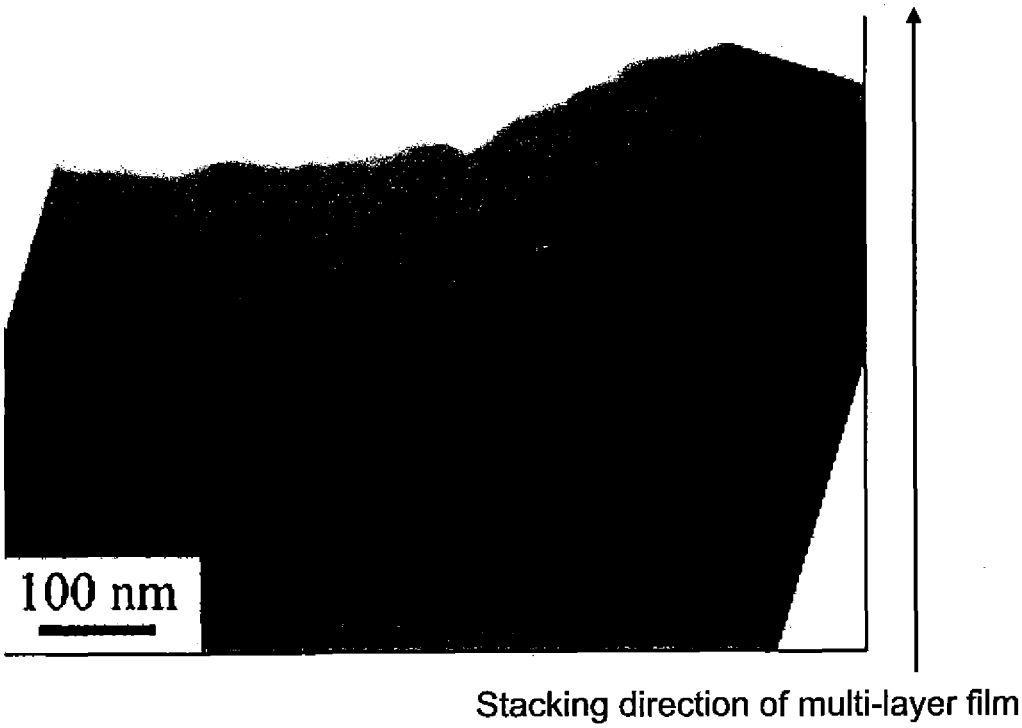
FIG. 6 is a TEM micrograph of a cross-sectional structure of a rare-earth nanocomposite magnet according to the present invention formed to a film in Example 3.

A TEM micrograph of a cross-sectional structure of the obtained nanocomposite magnet is shown in FIG. 6.

<Evaluation of Magnetic Properties>

Figure 7:
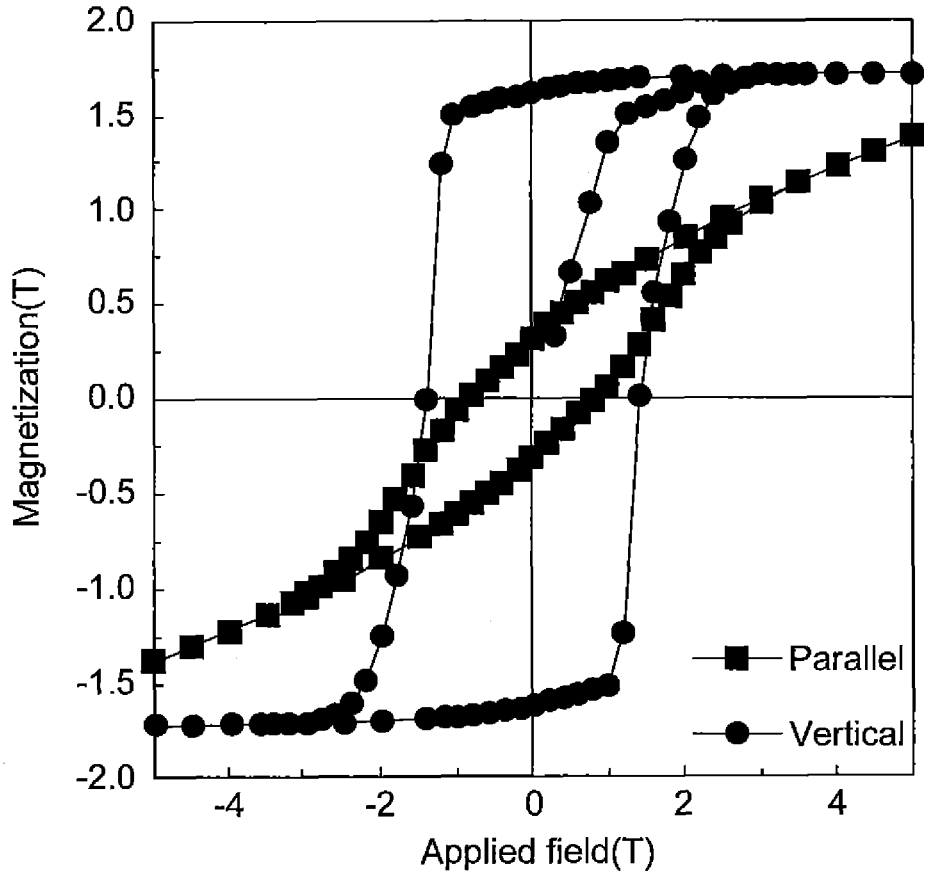
FIG. 7 is a magnetization curve of a rare-earth nanocomposite magnet according to the present invention having the structure of FIG. 5 and FIG. 6. The directions of an applied magnetic field are vertical (filled circle) and parallel (filled square) to the surface of a thin film sample.

The magnetization curve of the nanocomposite magnet produced in the current Example is shown in FIG. 7.

The directions of an applied magnetic field are vertical (plotted as filled circles in the Figure) and parallel (plotted as filled squares in the Figure) to the surface of a formed film.

Coercive force of 14.3 kOe, residual magnetization of 1.61 T, and maximum energy product of 62 MGOe were obtained in the vertical direction to the formed film surface. In particular, the value 1.61 T of residual magnetization exceeds a theoretical residual magnetization value of a single phase texture of $Nd_2Fe_{14}B$.

Comparative Example

As a Comparative Example, a conventional $Nd_2Fe_{14}B$ based rare-earth nanocomposite magnet, in which a non-ferromagnetic phase according to the present invention was not intercalated between a hard magnetic phase and a soft magnetic phase, was produced.

Figure 8:
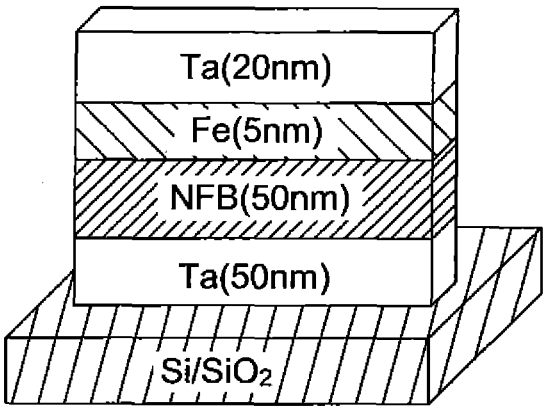
FIG. 8 is (1) a schematic diagram, and (2) a TEM micrograph of a cross-sectional structure of a conventional rare-earth nanocomposite magnet formed to a film in Comparative Example.
Figure 8:
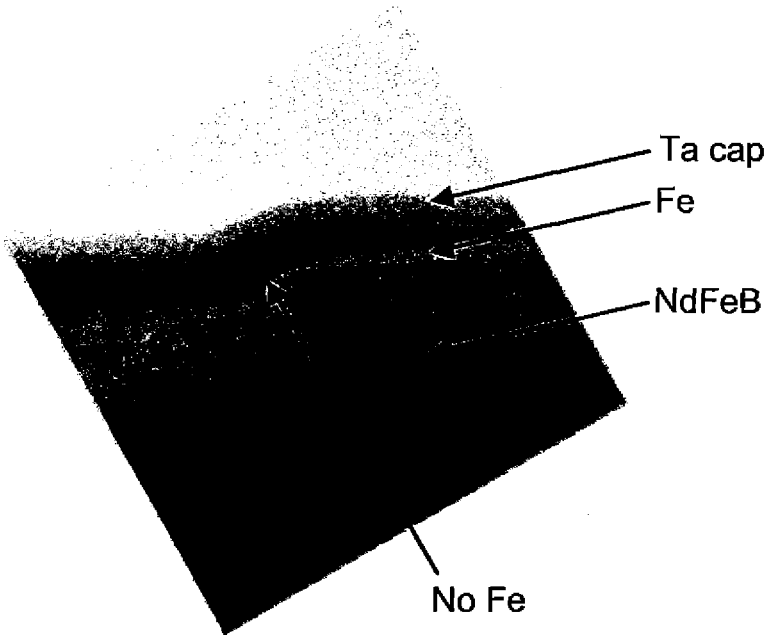

A film with the structure illustrated schematically in FIG. 8 (1) was formed by sputtering on a thermally-oxidized film ($SiO_2$) of a Si single crystal substrate. The conditions for film forming were as follows. In FIG. 8 (1) "NFB" stands for $Nd_2Fe_{14}B$.

<Film Forming Conditions>

A) lower Ta layer: formed at room temperature

B) $Nd_2Fe_{14}B$ layer: film formation at 550° C.+annealing at 600° C. for 30 min C) α-Fe layer+Ta cap layer: film formation between 200 to 300° C.

wherein the $Nd_2Fe_{14}B$ layer of B) is a hard magnetic phase, and the α-Fe layer of C) is a soft magnetic phase.

A TEM micrograph of a cross-sectional structure of the obtained nanocomposite magnet is shown in FIG. 8 (2). There is not a non-ferromagnetic phase (Ta phase) intercalated between a Nd2Fe14B layer as a hard magnetic phase and an α-Fe layer as a soft magnetic phase. As remarked in FIG. 8 (2) as "No Fe", an α-Fe layer as a soft magnetic phase has disappeared by diffusion at some region. At the region, a nanocomposite magnet structure is broken.

<Evaluation of Magnetic Properties>

Figure 9:
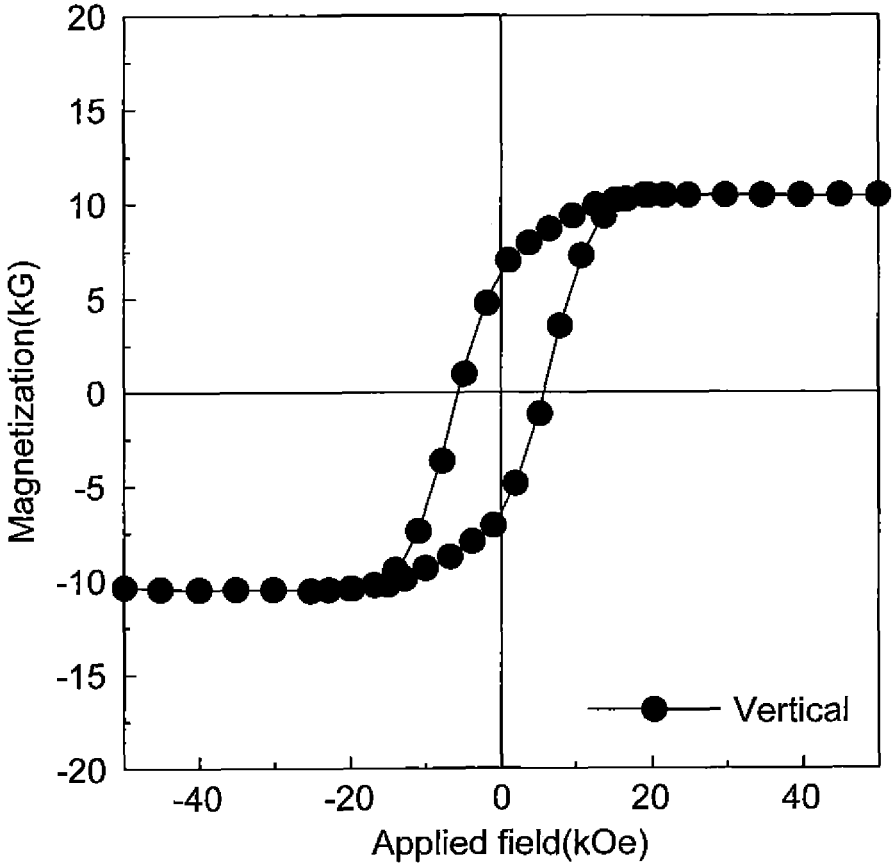
FIG. 9 is a magnetization curve of a conventional rare-earth nanocomposite magnet having the structure of FIG. 8. The direction of an applied magnetic field is vertical to the surface of a thin film sample.

The magnetization curve of the nanocomposite magnet produced in the current Comparative Example is shown in FIG. 9.

The directions of an applied magnetic field is vertical to the formed film surface.

Coercive force of 6 kOe, residual magnetization of 0.7 T, and maximum energy product of 6 MGOe were obtained in the vertical direction to the formed film surface.

The magnetic properties obtained in the Comparative Example and Examples 1 to 3 are summarized in Table 1.

TABLE 1

Results of Magnetic Properties

| | Coercive Force | Residual Magnetization | Maximum Energy Product |
|---|---|---|---|
| Comparative Example | 6 kOe | 0.7 T | 6 MGOe |
| Example 1 | 14 kOe | 1.55 T | 51 MGOe |
| Example 2 | 23.3 kOe | 1.5 T | 54 MGOe |
| Example 3 | 14.3 kOe | 1.61 T | 62 MGOe |

As obvious from Table 1, with respect to $Nd_2Fe_{14}B$ based rare-earth nanocomposite magnets, in which combinations of components of a hard magnetic phase and a soft magnetic phase are equivalent, a texture according to the present invention including a non-ferromagnetic phase intercalated between the hard magnetic phase and the soft magnetic phase has improved significantly all of coercive force, residual magnetization, and maximum energy product, compared to a texture according to a conventional art not having a non-ferromagnetic phase intercalated between the hard magnetic phase and the soft magnetic phase.

Example 4

Influences of the thickness of a non-ferromagnetic phase Ta and the thickness of a soft magnetic phase $Fe_2Co$ in a structure according to the present invention were examined. Further, for comparison, case without a Ta layer or a $Fe_2Co$ layer were also examined.

Figure 10:
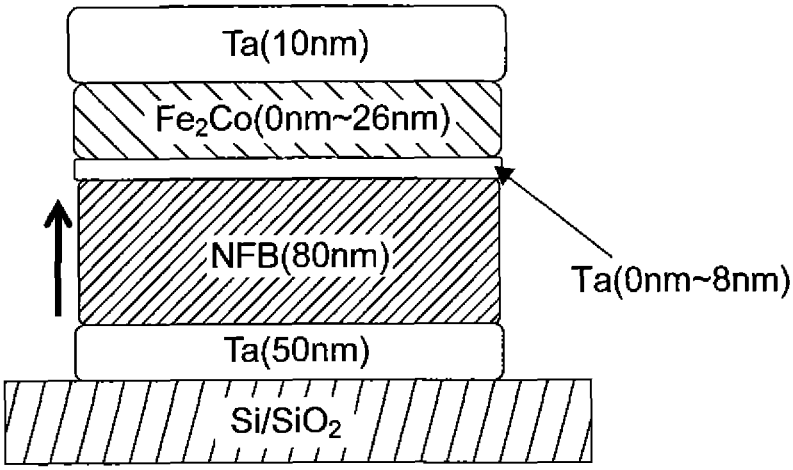
FIG. 10 is a schematic diagram of a cross-sectional structure (1) of a rare-earth nanocomposite magnet according to the present invention formed to a film in Example 4.

A film with the structure illustrated schematically in FIG. 10 was formed by sputtering on a thermally-oxidized film ($SiO_2$) of a Si single crystal substrate. The conditions for film forming were as follows. In FIG. 10 "NFB" stands for $Nd_2Fe_{14}B$.

<Film Forming Conditions>

A) lower Ta layer: formed at room temperature

B) $Nd_2Fe_{14}B$ layer: film formation at 550° C.+annealing at 600° C. for 30 min C') Ta spacer layer+α-Fe layer+Ta cap layer: film formation between 200 to 300° C.

wherein the $Nd_2Fe_{14}B$ layer of B) is a hard magnetic phase, the Ta spacer layer of C') is an intercalated layer between a hard magnetic phase and a soft magnetic phase, and the α-Fe layer of C') is a soft magnetic phase.

Thickness of Ta spacer layer: 0 nm to 8 nm

Thickness of $Fe_2Co$ layer: 0 nm to 26 nm

The thicknesses of a non-ferromagnetic phase Ta and a soft magnetic phase $Fe_2Co$ were measured by a transmission electron micrograph (TEM).

<Influence of Ta Spacer Layer>

Figure 11:
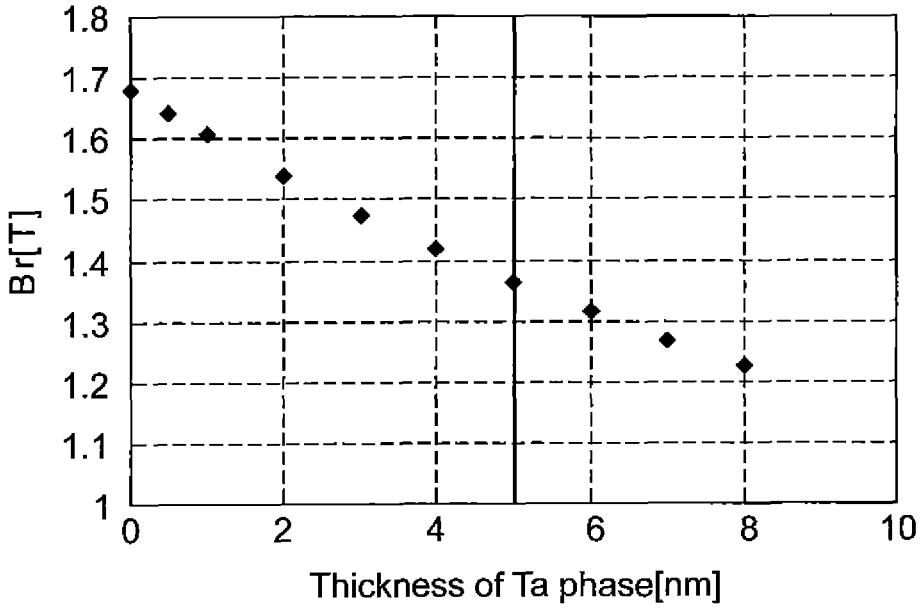
FIG. 11 is (1) a graph representing change of residual magnetization with the thickness of a Ta phase, and (2) a graph representing relationships between maximum energy product and the thickness of a Ta phase and a $Fe_2Co$ phase.
Figure 11:
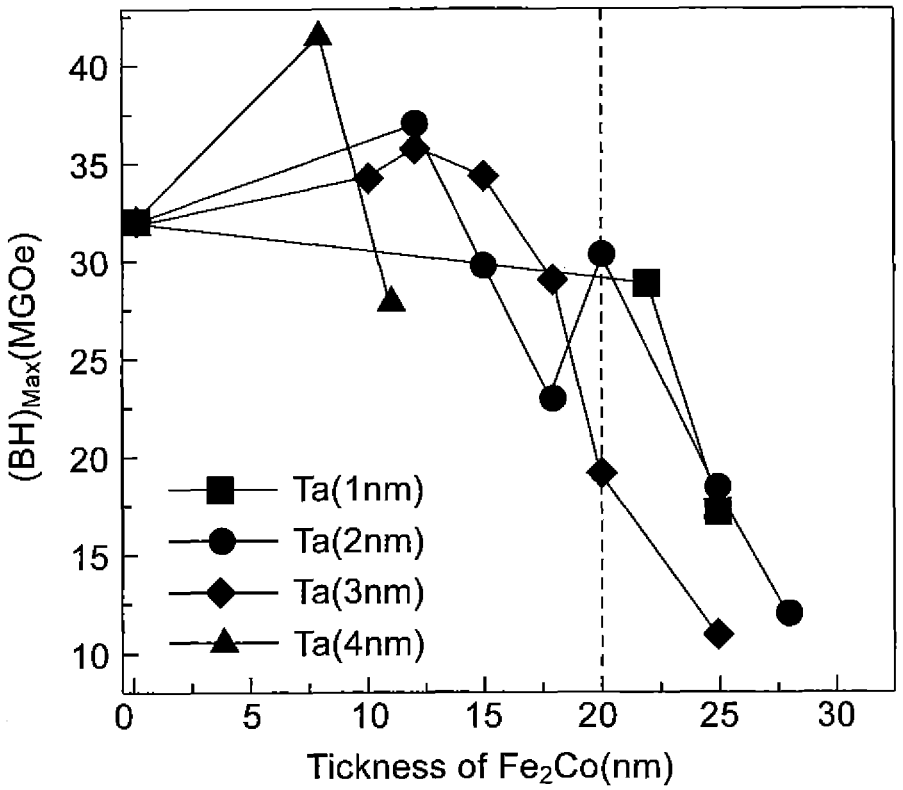

Change of residual magnetization Br, when the thickness of a Ta spacer layer as a non-ferromagnetic phase intercalated between a hard magnetic phase and a soft magnetic phase is changed, is shown in FIG. 11 (1). With increase of the thickness of the non-ferromagnetic phase, the volume fraction of a region generating magnetism decreases, and therefore residual magnetization decreases monotonically. To generate practical residual magnetization, it is appropriate to select the thickness of the Ta spacer layer as a non-ferromagnetic phase at 5 nm or less.

Change of maximum energy product, when the thickness of a $Fe_2Co$ layer as a soft magnetic phase is changed, is shown in FIG. 11 (2). As seen in the Figure, when the thickness of a soft magnetic phase exceeds 20 nm, the maximum energy product decreases sharply. Presumably, this is because magnetization reversal occurred more easily due to existence of a soft magnetic phase beyond exchange interaction length, which made coercive force and residual magnetization decrease.

Therefore the thickness of a $Fe_2Co$ layer as a soft magnetic phase is preferably 20 nm or less.

INDUSTRIAL APPLICABILITY

The present invention provides a nanocomposite magnet, which has achieved both high coercive force and high residual magnetization, and also improved maximum energy product.

The invention claimed is:

1. A rare-earth nanocomposite magnet, comprising:

a hard magnetic phase with a rare-earth magnet composition, the hard magnetic phase including $Nd_2Fe_{14}B$;

a grain boundary phase of the hard magnetic phase, including any one of the following (1) to (4) diffused therein:

(1) Nd, (2) Pr, (3) an alloy of Nd, and any one of Cu, Ag, Al, Ga, and Pr, and (4) an alloy of Pr, and any one of Cu, Ag, Al, and Ga;

a soft magnetic phase including Fe or $Fe_2Co$; and a non-ferromagnetic phase intercalated between the hard magnetic phase and the soft magnetic phase, the non-ferromagnetic phase including Ta, wherein the non-ferromagnetic phase reacts with neither the hard magnetic phase nor the soft magnetic phase.

2. The rare-earth nanocomposite magnet according to claim 1 wherein thickness of the non-ferromagnetic phase is 5 nm or less.

3. The rare-earth nanocomposite magnet according to claim 1 wherein the thickness of the soft magnetic phase is 20 nm or less.

4. The rare-earth nanocomposite magnet according to claim 2 wherein the thickness of the soft magnetic phase is 20 nm or less.

* * * * *